US006152722A

United States Patent [19]

Sick et al.

[11] Patent Number: 6,152,722

[45] Date of Patent: Nov. 28, 2000

[54] DEVICE FOR RECEIVING FORMWORK ELEMENTS FOR CONCRETE BUILDING ELEMENTS WHEN MANUFACTURING SAID BUILDING ELEMENTS

[75] Inventors: Georg Sick, Feldafing; Edith Kramp; Johann Breitenbach, both of München; Alexander Mark, Unterschleissheim, all of Germany

[73] Assignee: Wacker-Werke GmbH & Co., KG, Germany

[21] Appl. No.: 09/202,852

[22] PCT Filed: Jul. 22, 1997

[86] PCT No.: PCT/EP97/03957

§ 371 Date: Dec. 17, 1998

§ 102(e) Date: Dec. 17, 1998

[87] PCT Pub. No.: WO98/05482

PCT Pub. Date: Feb. 12, 1998

[30] Foreign Application Priority Data

Aug. 3, 1996 [DE] Germany ..... 196 31 516

[51] Int. Cl.[7] ..... B28B 1/08

[52] U.S. Cl. ..... 425/211; 425/424; 425/432; 425/456; 264/71

[58] Field of Search ..... 425/211, 432, 425/424, 456; 264/71

[56] References Cited

U.S. PATENT DOCUMENTS

| | | | |
|---|---|---|---|
| 3,528,144 | 9/1970 | Haponski | 25/41 |
| 3,863,484 | 2/1975 | Tsuji et al. | 72/274 |
| 4,193,754 | 3/1980 | Sekiguchi | 425/424 |
| 4,238,177 | 12/1980 | Crile et al. | 425/150 |
| 4,761,925 | 8/1988 | Fukahori et al. | 52/167 |
| 4,830,916 | 5/1989 | Fukuda et al. | 428/138 |
| 4,935,178 | 6/1990 | Esposito et al. | 264/56 |
| 5,063,098 | 11/1991 | Niwa et al. | 428/76 |
| 5,240,221 | 8/1993 | Thomasen | 248/559 |
| 5,260,011 | 11/1993 | Wolter et al. | 264/56 |

FOREIGN PATENT DOCUMENTS

| | | |
|---|---|---|
| 0 251 150 | 1/1988 | European Pat. Off. . |
| 24 22 252 | 5/1974 | Germany . |
| 74 29 370 | 12/1974 | Germany . |
| 24 22 252 | 11/1975 | Germany . |
| 709 363 | 1/1980 | Russian Federation . |

*Primary Examiner*—Harold Pyon
*Assistant Examiner*—Joseph S. Del Sole
*Attorney, Agent, or Firm*—Boyle Fredrickson Ziolkowski S.C.

[57] ABSTRACT

A device for receiving formwork elements used to manufacture concrete elements has a bearing static structure and a flat formwork joined therewith which can be driven to vibrate by an exciting device in order to compact the still-plastic concrete. The sound-insulating joining devices are inserted between the formwork shell and the static structure. The exciting device bypasses the joining device and acts directly or indirectly on the formwork shell.

17 Claims, 2 Drawing Sheets

DEVICE FOR RECEIVING FORMWORK ELEMENTS FOR CONCRETE BUILDING ELEMENTS WHEN MANUFACTURING SAID BUILDING ELEMENTS

BACKGROUND OF THE INVENTION

1. Field of the Invention

The invention relates to a device for receiving formwork elements for the manufacture of concrete structural parts.

In the production of precast concrete parts, the formwork elements in the concrete works are normally arranged on vibrating tables which serve for compacting the concrete cast for forming purposes, using the formwork elements. Such a vibrating table usually consists of a carrying structure comprising steel bearers and of a steel plate forming the table plate. To make it simpler to remove the formwork and to lift off the fully hardened concrete parts, vibrating tables are often designed with a tiltable table plate. The vibrating tables are usually equipped with an exciter in the form of external vibrators which are arranged so as to be distributed over the table plate and which can set the carrying structure composed of the steel bearers and of the table plate in vibration. The external vibrators have electromotively, pneumatically or hydraulically driven flyweights and are mounted in a suitable way in the carrying structure of the vibrating table. After the forming formwork elements have been built up on the vibrating table plate and the fresh concrete has been cast into the formwork elements and into the reinforcements often inserted into these, the external vibrators are set in motion, thus giving rise to complex forms of vibration in the carrying structure and, in particular, in the vibrating table plate which result in the concrete being compacted. In the known vibrating tables, the vibratory energy introduced into the concrete is distributed more or less unequally. The carrying structure supporting the vibrating table plate is excited by the external vibrators mounted there, just as is the table plate, thus resulting in jarring knocks between parts of the carrying structure and in complex transmission and propagation of sound into the air which has a considerable adverse effect on the working conditions of the labor force and may pollute the environment in a way detrimental to health. Sound pressure values of more than 100 dba are often reached.

In order to reduce the very annoying high sound level in precast concrete works when vibrating tables operated by means of external vibrators are used, the following measures have already been put into practice:

a) Optimization of the position and frequency of the external vibrators, the aim also being, in particular, to avoid resonant frequencies,
b) Stiffening of the carrying structure of the vibrating tables and improvement in the connections between carrying elements in order to avoid jarring knocks,
c) Use of insulating material in order to have a positive influence on the sound transition,
d) Use of vibration-absorbing materials between the elements of the carrying structure in order to avoid solidborn sound transmissions, and
e) Vibrational uncoupling of the carrying structure from the ground and force or displacement excitation in a horizontal plane at low frequencies, in order to avoid generating high frequencies which are particularly annoying.

The above mentioned measures are effective, individually or in a suitable combination, for reducing the generation of noise in the vicinity of the vibrating tables. Their subsequent use on existing vibrating tables, not equipped or only inadequately equipped with measures for sound reduction, necessitates complicated additional work and requires complicated changes to the system. Moreover, the improvements capable of being achieved thereby are very limited, apart from the use of the horizontal vibrating or gyro technique which, again, presents problems in achieving a sufficient compacting performance and is therefore not acknowledged.

2. Description of the Related Art

EP-A-0,251,150 shows a device for receiving formwork elements for the manufacture of concrete structural parts, with a static carrying structure and with a sheetlike formwork shell connected to the latter and capable of being set in vibration by a vibrator in order to compact the still plastic concrete. Damping spacer elements are inserted between the formwork shell and the static structure. The vibrator engages the formwork shell, bypassing the spacer elements.

OBJECT AND SUMMARY OF THE INVENTION

Preferably, the connection between the formwork shell and the static structure are designed as an intermediate layer arranged between these and consisting of a sound-insulating and vibration-insulating material, and the exciter engages through this intermediate layer on the formwork shell.

BRIEF DESCRIPTION OF THE DRAWINGS

The invention is explained in more detail below in an exemplary embodiment with reference to the drawing in which.

DESCRIPTION OF THE PREFERRED EMBODIMENTS

Figure 1:
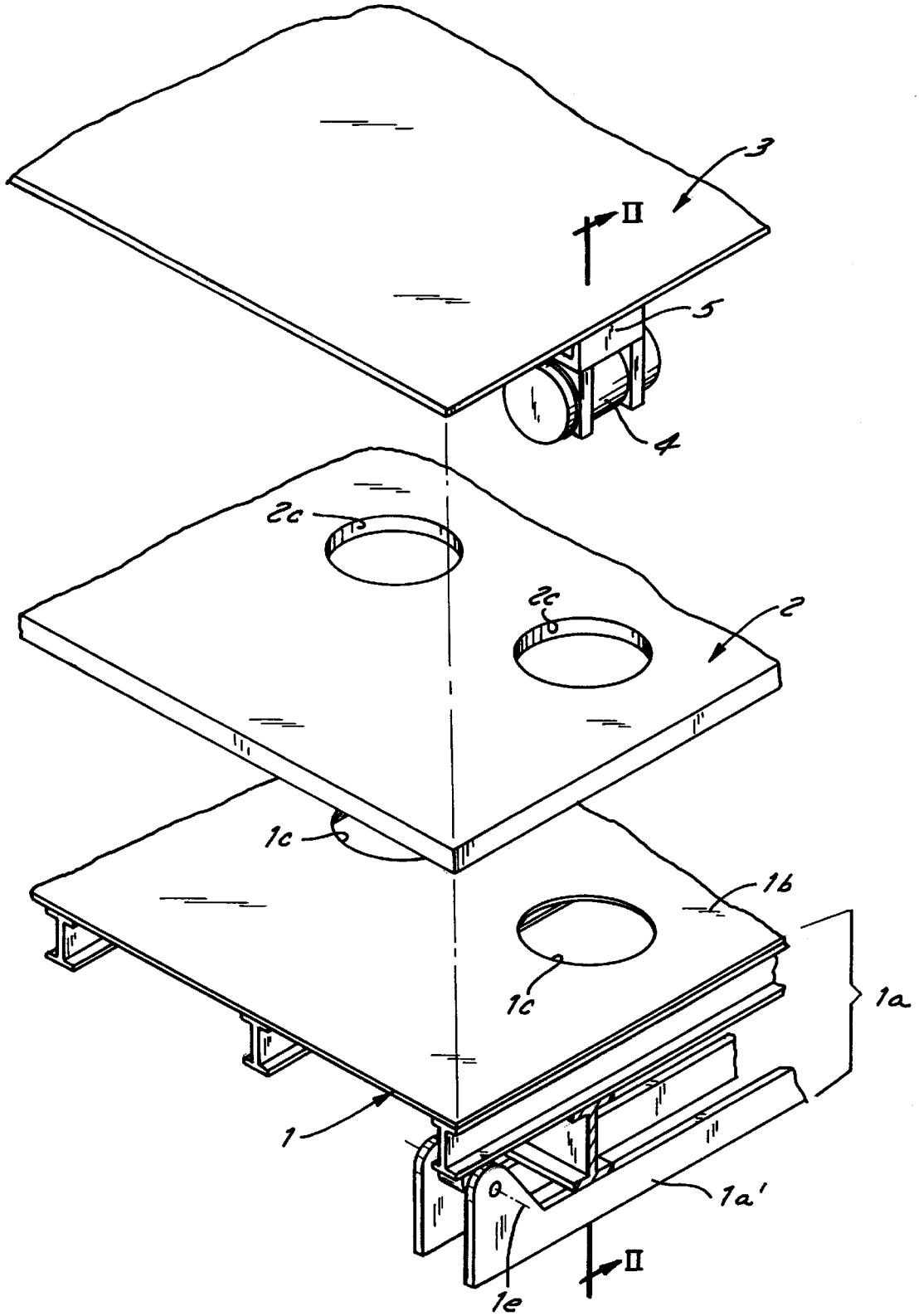
FIG. 1 shows a device according to the invention in a diagrammatic perspective view in the exploded state, the individual parts of the device being illustrated as being cut away.
Figure 2:
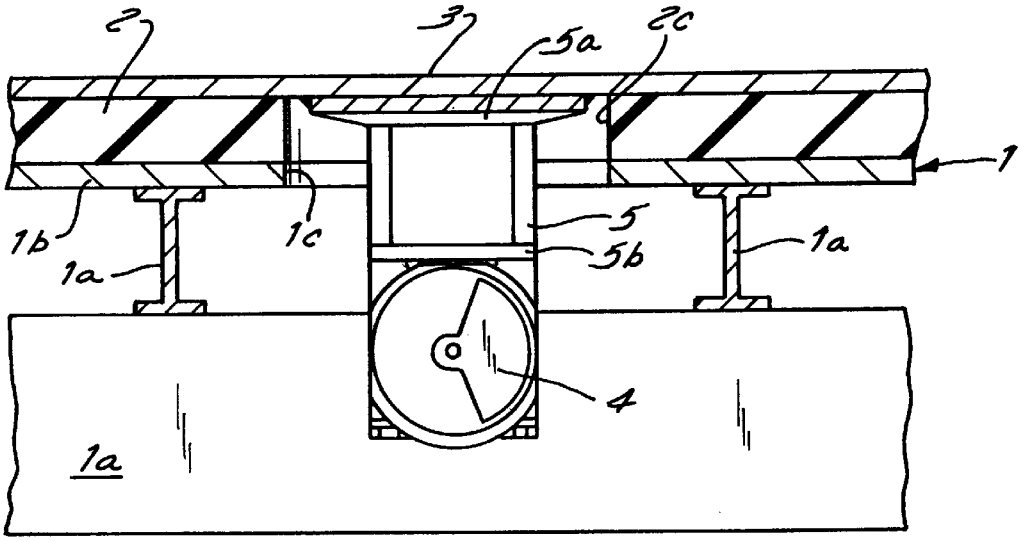
FIG. 2 shows the cross section along the sectional line II—II through the device according to FIG. 1 in the assembled state.

The device according to FIG. 1 and FIG. 2 has a static structure consisting of steel supports or bearers 1*a* and of a plate 1*b* which is arranged on the bearers and is horizontal in the compaction mode and which, as a rule, consists of steel. However, it may also be formed from other materials having high strength. It is also provided with continuous orifices 1*c*. The static structure 1 may be a vibrating table of a conventional simple nondamped type, in the table plate 1*b* of which the continuous orifices 1*c* have subsequently been cut out.

As indicated in FIG. 1, the upper part of the static structure having the plate 1*b* may be connected so as to be upwardly pivotable about a pivot axis 1*e* in relation to a lower part 1*a*' of the bearers 1*a* anchored firmly to the ground, in order to make it easier to handle the finished concrete structural part, in particular release it from the formwork. In this case, holding elements (not shown) should be provided to hold the formwork shell 3 and the intermediate layer 2 on the table plate 1*b* when the table plate is pivoted from its horizontal position.

An intermediate layer 2 is placed on the static structure 1. The intermediate layer 2 has continuous orifices 2*c* which, when the device as a whole is in the assembled state, coincide with the orifices 1*c* of the plate 1*b* of the static structure. As indicated in FIGS. 2 and 3, the intermediate layer has a honeycomb structure.

When the device is in the assembled state, the intermediate layer 2, the properties of which are explained in more detail further below, has resting on it a formwork shell 3 which, as a rule, consists of steel. It may also consist of other materials having steellike properties, such as a glass fiber reinforced hard plastic. Vibration exciters in the form of external vibrators 4 are fastened to this formwork shell 3 so as to fit through the orifices 1*c* of the plate 1*b* and the orifices 2*c* and to be distributed over the entire area of the formwork shell 3.

Figure 3:
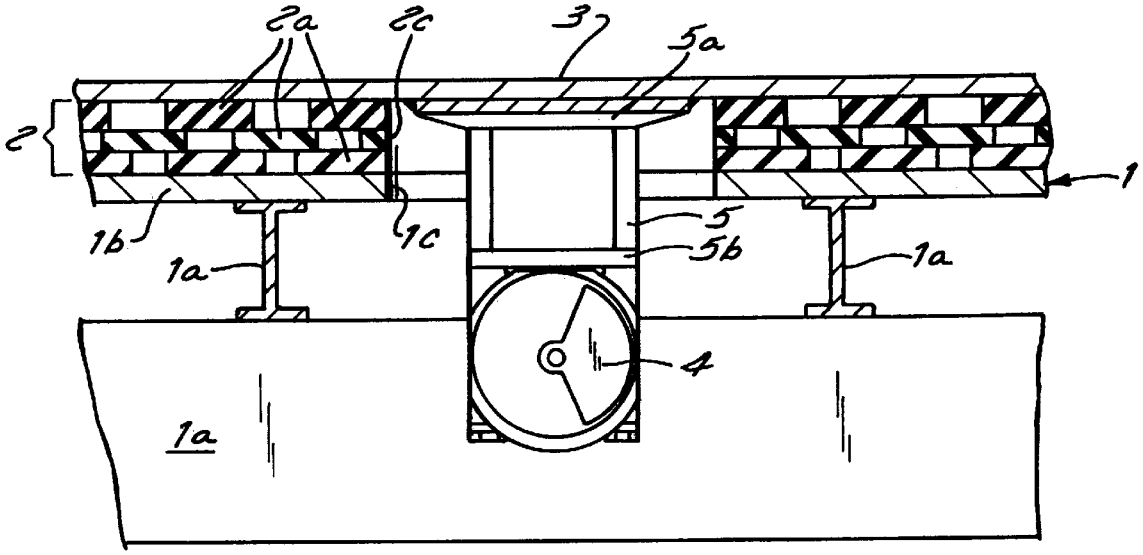
FIG. 3 shows the cross section along the sectional line II—II through the device according to FIG. 1, with an intermediate layer modified in relation to FIG. 2.

As is evident from FIGS. 2 and 3, the individual external vibrators 4 may in each case be fastened to end fastening plates 5*a* and 5*b* via a vibration transmission element 5 which passes through the orifices 1*c*, 2*c* and which is mounted, for example welded, rigidly, by means of its upper fastening plate 5*a*, to the formwork shell 3 and, at its end projecting from the orifices 1*c*, 2*c*, carries the external vibrator 4 fastened, for example screwed, to its fastening plate 5*b* located there.

The intermediate layer 2 is a viscoelastic layer which supports the formwork shell 3 from below, without any other carrying structure, and which has a strength withstanding the mean surface pressure. This viscoelastic layer appreciably reduces the transmission of sound, emanating from the external vibrators 4 and the formwork shell 3, to the static structure, 1*a*, 1*b* located underneath, these vibrations otherwise being one of the main causes for the radiation of noise into the vicinity of the vibrating table or receiving device. Furthermore, the intermediate layer 2, being formed of a viscoelastic layer and engaging at least a substantial portion of the bottom surface of the formwork shell, is conducive to equalizing and intensifying the vibration, caused by the external vibrators 4, of the formwork shell 3 located above the intermediate layer, for the purpose of stimulating the compaction of the concrete.

Preferably, the viscoelastic intermediate layer 2 consists of a gradient material which is relatively flexible in relative proximity to the formwork shell 3 and thus has mechanical properties conducive to the propagation of vibrations in the formwork shell 3 resting on it. It also has damping and plastic properties on the side facing the static structure, in order largely to avoid the transmission of solidborne sound to the static structure 1*a*, 1*b*. These properties of the intermediate layer may be achieved in various ways, for example by connecting various suitable basic materials to one another or by using composite materials, the mechanical properties of which meet the requirements.

The desired properties of the intermediate layer may be obtained, for example, by means of different aggregates in height segments, located one above the other, of an intermediate layer which, according to FIG. 2 consists of an otherwise identical, that is to say monolithic basic material.

According to FIG. 3, another possibility for obtaining an intermediate layer with gradient properties is for the intermediate layer 2 to be composed of a plurality of plies laid one above the other. In the version according to FIG. 3, three plies 2*a* are provided. Each of the three plies of the intermediate layer 2 which lie one above the other has different elastic and sound-insulating properties, depending on how large a percentage of voids there is in that layer, how thick the ply is, and what elasticity properties the material used for it has. The uppermost ply of the plies 2*a* facing the formwork shell 3 is relatively flexible. The middle ply, by contrast, has a higher modulus of elasticity, and the lowermost ply which faces the static structure 1*a*, 1*b* having mainly sound-insulating and plastic properties which primarily prevent, or at least considerably reduce, the transmission of sound to the static structure.

The external vibrators 4 are preferably operated (not illustrated) in each case by means of miniaturized frequency converters which are located in them and which, in conjunction with the external vibrators 4, have a control system for the rotational speed and, consequently, for the force-excited vibration frequency. Thus, by means of remote control, the frequency of the individual external vibrators can then be set independently of one another, this being highly conducive to equalizing the vibration profile of the formwork shell 3.

Preferably, the vibration transmission elements 5 are designed in such a way that the vibration system consisting of them, of the formwork shell 3 and of the external vibrators 4 resonates at the selected desired exciting frequency, thereby achieving force amplification in vibration excitation. This force amplification in vibration excitation is achieved, via the optimization of the material dimensions and the tuning of the frequencies, in such a way that the formwork shell 3, which is excited directly by the external vibrators 4 and is located above the intermediate layer 2 and which, for example, may have a thickness of 5 mm for a surface of a plurality of square meters, is set in resonant vibration. However, the special design of the connection of the external vibrators to the formwork shell 3 via the vibration transmission elements 5 ensures that, in this case, sound is not transmitted through solid structures, or is transmitted only in a very highly damped manner, to the existing static structure 1*a*, 1*b*.

The invention is also particularly suitable for use on existing vibrating tables which have no or only inadequate sound insulation, since, in these vibrating tables, apart from the demounting of the external vibrators from their previous positions, which is simple to carry out, it is necessary merely for the existing table plate to be provided with orifices for leading through the vibration transmission elements 5. As a result, the existing vibrating table can be used as a static carrying structure for the device according to the invention.

We claim:

1. A device for receiving formwork elements for the manufacture of concrete structural parts, the device comprising:

(A) a static carrying structure;

(B) a formwork shell which 1) has a flat upper surface that forms means for directly supporting the concrete, and 2) defines means for being set in vibration;

(C) an intermediate layer via which the formwork shell is supported on the static structure, the intermediate layer being formed from a sound-insulating and vibration-insulating viscoelastic material disposed between the static structure and the formwork shell; and (D) exciter means, bypassing the intermediate layer and engaging the formwork shell, for setting the formwork shell in vibration so as to compact still-plastic concrete supported directly thereon, and wherein the intermediate layer insulates the static structure from sound and vibrations in the formwork shell.

2. The device according to claim 1, wherein the intermediate layer defines means for assisting in the vibratory excitation of the formwork shell by distributing the vibratory excitation uniformly over the formwork shell.

3. The device according to claim 1, wherein the intermediate layer extends uniformly under essentially the entire formwork shell.

4. The device according to claim 1, wherein the static structure comprises a table plate which is pivotable from a horizontal position towards a vertical position in order to discharge the concrete from the formwork shell.

5. The device according to claim 1, wherein the intermediate layer is formed from a gradient material which damps the vibrations of the formwork shell.

6. The device as recited in claim 5, wherein the gradient material comprises a plurality of vertically stacked plies having different moduli of elasticity.

7. The device according to claim 1, wherein the exciter means comprises a plurality of external vibrators distributed about the formwork shell.

8. The device according to claim 7, wherein the vibrators engage the formwork shell only indirectly through discrete vibration transmission elements which pass through orifices in the intermediate layer, and wherein the vibrators and the vibration transmission elements are configured to excite the formwork shell at a frequency that ensures force amplification in vibration excitation.

9. A device for receiving formwork elements for the manufacture of concrete structural parts, said device comprising:

a static carrying structure;

a formwork shell, said formwork shell 1) having an upper surface that forms means for directly supporting the concrete, 2) being connected to the static structure, and 3) defining first means for being set in vibration in order to compact the still plastic concrete;

a sound-insulation connecting structure inserted between the formwork shell and the static structure; exciter means, bypassing the connecting structure, for engaging indirectly or directly on the formwork shell and for exciting vibrations in the formwork shell that compact still plastic concrete supported on the formwork shell, wherein the connecting structure includes a viscoelastic intermediate layer consisting of a sound-insulating and vibration-insulating material disposed between the static structure and the formwork shell.

10. The device as claimed in claim 9, wherein the exciter means and the intermediate layer, in combination, define second means for assisting in the vibratory excitation of the formwork shell by distributing it uniformly over the formwork shell.

11. The device as claimed in claim 9, wherein the intermediate layer extends essentially uniformly under the formwork shell.

12. The device as claimed in claim 9, wherein the intermediate layer consists of a gradient material which damps the vibrations of the formwork shell but which performs a sound-insulating function in respect of the static structure.

13. The device as claimed in claim 9, wherein the exciter means includes external vibrators arranged so as to be distributed over the formwork shell and acting either directly or indirectly on the formwork shell.

14. The device as claimed in claim 9, wherein vibration transmission elements pass through the intermediate layer and are located between the exciter means and the formwork shell.

15. The device as claimed in claim 14, wherein the vibration transmission elements are designed in such a way that a vibration system consisting of the vibration transmission elements, the formwork shell, and the exciter means resonates at a selected exciting frequency.

16. The device as claimed in claim 14, wherein the static structure includes a substructure and a table plate of a vibrating table, and wherein orifices are formed in the table plate for the passage of the vibration transmission elements.

17. The device as claimed in claim 16, wherein the table plate can be pivoted between a horizontal position and a vertical position.

* * * * *